US007163102B2

(12) United States Patent
Palamara et al.

(10) Patent No.: US 7,163,102 B2
(45) Date of Patent: Jan. 16, 2007

(54) DISPOSABLE PACKAGING FOR A READY-MADE FOOD PRODUCT

(76) Inventors: Antonio Palamara, Via dei Garibaldini 104, Catona, Reggio Calabria (IT) 89053; Mariantonia Cotronei, Via dei Garibaldini 104, Catona, Reggio Calabria (IT) 89053

( * ) Notice: Subject to any disclaimer, the term of this patent is extended or adjusted under 35 U.S.C. 154(b) by 129 days.

(21) Appl. No.: 10/482,853

(22) PCT Filed: Jul. 10, 2002

(86) PCT No.: PCT/IT02/00454

§ 371 (c)(1),
(2), (4) Date: Jan. 5, 2004

(87) PCT Pub. No.: WO03/006323

PCT Pub. Date: Jan. 23, 2003

(65) Prior Publication Data

US 2005/0061688 A1 Mar. 24, 2005

(30) Foreign Application Priority Data

Jul. 13, 2001 (IT) ..... RM20010132 U
Mar. 27, 2002 (IT) ..... RM20020056 U

(51) Int. Cl.
*B65D 25/08* (2006.01)

(52) U.S. Cl. ..... 206/219; 206/221; 215/DIG. 8

(58) Field of Classification Search ..... 206/219–222; 215/6, DIG. 80; 220/523
See application file for complete search history.

(56) References Cited

U.S. PATENT DOCUMENTS 2,764,983 A * 10/1956 Barasch et al. ..... 206/220
3,477,431 A * 11/1969 Walecka ..... 604/89
3,756,571 A * 9/1973 Winberg ..... 206/221
4,024,952 A * 5/1977 Leitz ..... 206/221
4,793,476 A * 12/1988 Schrupp ..... 206/222
5,209,348 A * 5/1993 Schafer, III ..... 206/222
6,021,892 A * 2/2000 Baudin ..... 206/221
6,257,428 B1 * 7/2001 Caola ..... 215/11.1
6,481,571 B1 * 11/2002 Kelders et al. ..... 206/219

FOREIGN PATENT DOCUMENTS

EP 0790190 A 8/1997
GB 2211479 A 7/1989

* cited by examiner

*Primary Examiner*—Jila M. Mohandesi
(74) *Attorney, Agent, or Firm*—David A. Guerra

(57) ABSTRACT

Disposable packaging, comprising a container (1) that defines a main compartment (2) and at least an additional compartment (3). The container (1) is bowl-shaped and is closed on the upper side by a film, or by a cover, in order to prevent the main food component contained inside the main compartment (2)—from coming out. Moreover, the additional compartment (3) is closed by a slidable sealing system of the cylinder-piston type. In the closure position of the piston, which is formed by a plug (14), the food component contained in the additional compartment (3) cannot mix with the food component located in the main compartment (2), whereas in the opening position of the plug (14), the dressing/seasoning may leak from the additional compartment (3) through lateral apertures of the plug (14), at the time the user turns over and shakes the packaging.

8 Claims, 9 Drawing Sheets

DISPOSABLE PACKAGING FOR A READY-MADE FOOD PRODUCT

CROSS-REFERENCE TO RELATED APPLICATIONS

This application is an U.S. national phase application under 35 U.S.C. §371 based upon co-pending International Application No. PCT/IT02/00454 filed Jul. 10, 2002. Additionally, this U.S. national phase application claims the benefit of priority of co-pending International Application No. PCT/IT02/00454 filed Jul. 10, 2002, Italian Application No. IT RM2001U000132 filed Jul. 13, 2001, and Italian Application No. IT Rm2002U000056 filed Mar. 27, 2002. The entire disclosures of the prior applications are incorporated herein by reference. The international application was published Jul. 29, 2004 under Publication No. WO 03/006323 A2.

TECHNICAL FIELD

The present invention relates to the field of food products' packaging, and specifically to a packaging designed to contain food products that are ready to be eaten or ready for preparation and that consist of two or more components to be mixed together before use.

For instance, the invention may be used to mix vegetables with their dressings, pasta with sauces or gravies, breadcrumbs % kith beaten eggs (for the preparation of omelettes), meat or fish with their coverings of breadcrumbs (for the preparation of fried dishes), and so on.

Therefore, the invention is not only useful for the final user, that is, for the person who will actually eat the food product, but could be employed in the kitchen of a restaurant, or in the domestic environment, in order to facilitate or speed up the preparation of food products that precedes their successive treatment (e.g. frying, cooking inside a microwave oven, etc.).

BACKGROUND ART

At present, there are known various kinds of packaging for ready-made food products, that are used both in the domestic and non-domestic environment. These kinds of packaging include a plastic-made container (receptacle) which is open uppwardly—like a bowl—, and which is completely wrapped by a sealing film of cellophane or the like.

The container has at least one compartment for a first food component to be seasoned, and at least a second compartment for small bags (sachets) containing a sauce or the like.

The user that has removed the external seating film (or possibly an upper cover of the container) opens one or more sachets available to him, after taking them from the respective compartment, and then pours their content in the compartment that contains the food product to be seasoned.

A drawback of such a packaging for food is that it is very easy to inadvertently pour the content of the small bags on one's clothes or on other objects, and therefore this operation is not very convenient and hygienic to carry out. Moreover, since the food to be seasoned usually occupies (due to space optimisation) the whole volume of its respective compartment (forming the greatest part of the volume of the packaging), the operation of seasoning the food product (e.g. salad) is very difficult, if not impossible to carry out, if one wants to avoid to pour (spread) the food product out of the already opened packaging.

Therefore, an object of the present invention is to provide a packaging for food, that allows to mix the various components of the food in a hygienic and efficient way.

The use of compartmented storage containers is known in the prior art. For example, European Patent Number EP 0790190; Great Britain Patent Number GB 2,211,479 A; U.S. Pat. No. 4,793,476.

DISCLOSURE OF INVENTION

The above objects are attained according to the claims, by means of a ready-made dish disposable packaging with several compartments:

an upwardly open container (1), an upper closure element (A) of the container (1), a compartment (2) of the container (1) for a first component of the food product, and at least an additional compartment (3) that is realised integrally with the container (1) or is rigidly fixed thereto in a non-removable manner, and which is used for an additional component of the food product to be mixed to said first component, said additional compartment (3), which is initially sealed, having movable members (13, 14) that may be actuated by the user from outside the container (1) and which realise a communication path between the compartment (2) and said additional compartment (3), thereby allowing to mix the first component of food product, located inside the compartment (2), to the additional component of food product coming from the additional compartment (3), said movable members being formed by a base (13) of said additional compartment (3), that is connected by means of a hinge (15) to the walls (9) of the compartment (3), and said base (13) being movable between a first- or rest-position, and a second position, whereby during the displacement to the second position the base acts on a movable plug (14) which slides along the walls of said additional compartment (3); said plug (14) having lateral apertures which give rise to said communication between the compartment (2) and the additional compartment (3), in said second position of the movable base (13), when said plug (14) has reached a second, final position, without releasing itself from said walls (9) of the compartment (3).

The above objects are also attained by a combination between a disposable packaging for a first component of a food product, and a separate and sealed container (24) for a second component of the food product, in which:

the packaging comprises a container (1) with an upper closure element and a lower closure element, a compartment (2) for the first component of the food product in which said components are to be mixed together, and a coupling hole (11") for the connection to said sealed separate container (24);

the initially sealed container (24) has movable piston-like members (13', 14) that are actuated by the user and realise a communication path between said compartment (2), and an additional compartment (3) defined by the separate sealed container (24) itself, after the removal of the lower closure element, after the mechanical coupling of the separate sealed container (24) to the coupling hole (11"), and lastly, after the actuation of said movable members (13', 14), said movable members are formed by a base (13') of said additional compartment (3), connected by a hinge (15') to the walls (9') of the compartment (3), and wherein said base (13') is movable between a first- or rest-position, and a second position, and during the displacement to the second position the base acts on a movable plug (14) that slides along the walls of said additional compartment (3); the said plug (14) having lateral apertures which give rise to said communication path between the compartment (2) and the additional compartment (3), in said second position of the movable base (13').

As disclosed in more detail, the movable members could also be designed to break the sealing means of the additional compartment, and form—for instance—a push rod or pointed rod having an oblique upper end, designed to break a sealing plastic/aluminium film of the additional compartment.

The pointed rod or push rod is preferably integrally formed with the container during the plastic moulding process.

The push rod has longitudinal channels in order to facilitate the leaking of the sauce, dressing, or the like, from the additional compartment.

The advantages of the present invention will result from the detailed description of its preferred embodiments.

BRIEF DESCRIPTION OF DRAWINGS

The present invention and its specific advantages will be described for purely illustrative and non-limitative purposes, with reference to the accompanying drawings, in which:

FIG. 11 is a vertical sectional view—enlarged with respect to FIGS. 9 and 10—of the additional compartment containing the dressing or the like;

DETAILED DESCRIPTION OF PREFERRED EMBODIMENTS

The present invention will be described referring to FIGS. 1–7.

Then, we will describe the embodiments of the present invention, with reference to FIGS. 8–12.

In all figures the same reference number is used for an identical component of the packaging, so that the invention may be more readily understood.

The packaging essentially comprises a container 1 which for instance is obtained from a moulding process of plastics.

The configuration of the container 1 is such as to give rise to two separate compartments, denoted by 2 and 3 respectively. The compartment 3 is centrally located and has a cylindrical shape, while the greater compartment 2, that surrounds the compartment 3, has a substantially prismatic and polygonal shape with several congruent faces. Obviously, these shapes of the compartments are not limitative, and the same holds for the position of the compartment 3, although for a more uniform distribution of the food product component contained in the compartment 3 towards the inside of the compartment 2, containing the other component of the food product, the preferred position is the illustrated one.

Figure 4A:
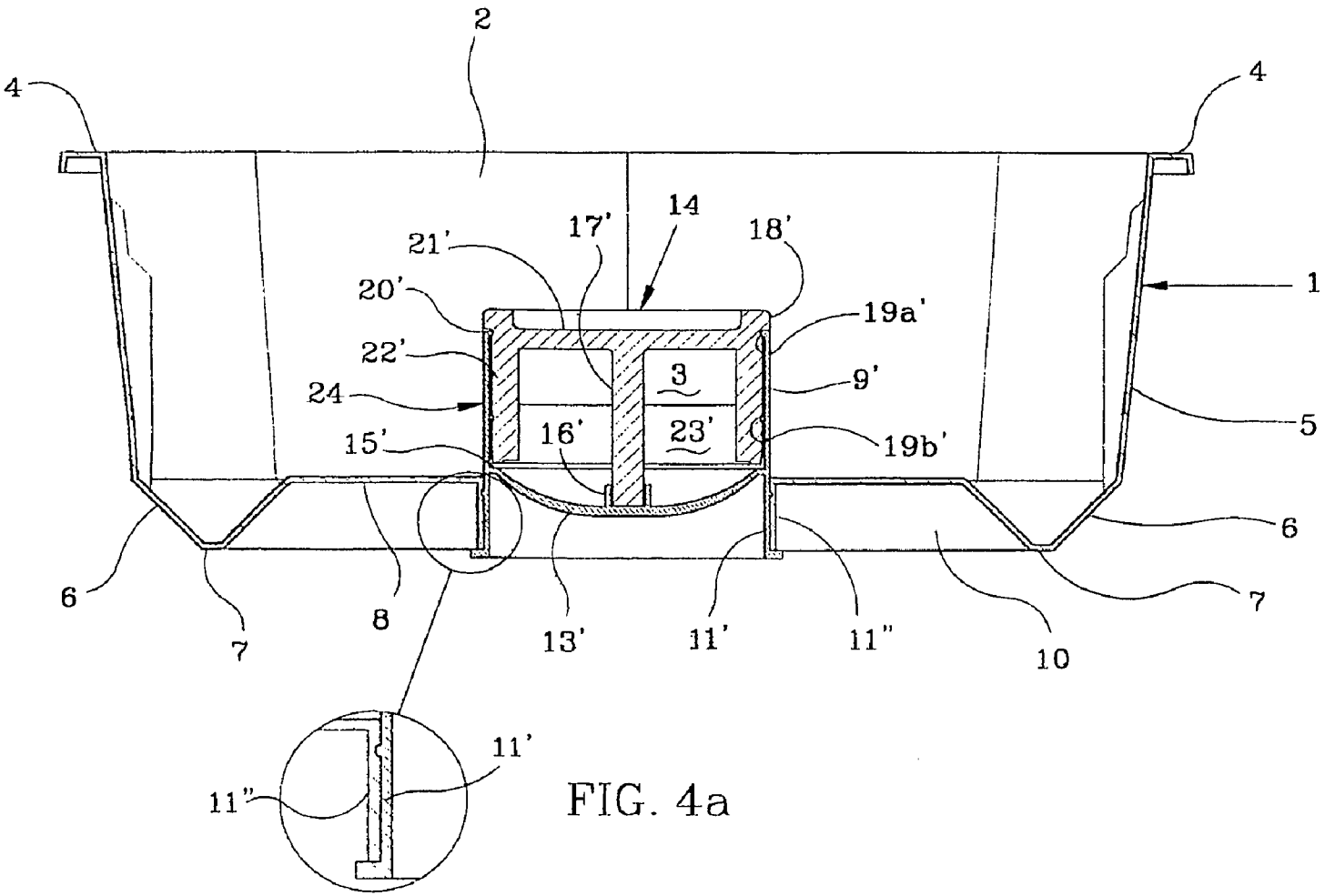
FIGS. 4*a* and 4*b* are vertical sectional views of the invention, corresponding to an embodiment of the present invention.
Figure 7:
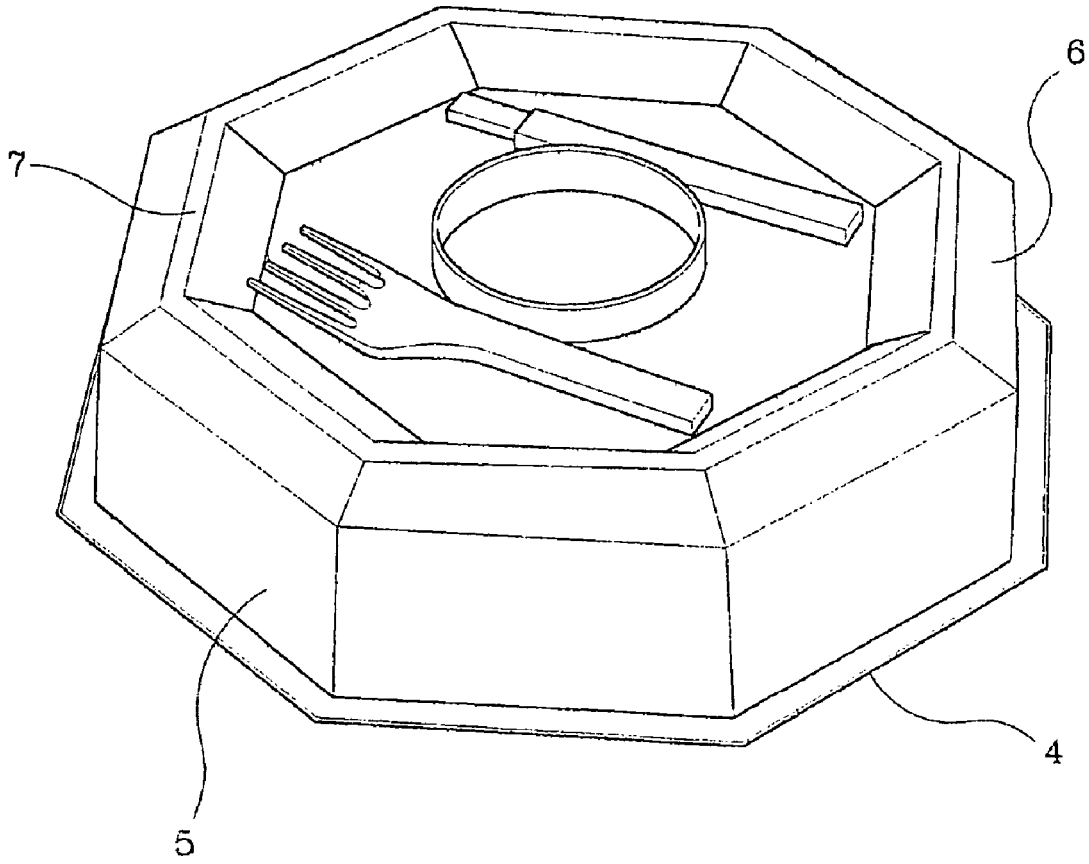
FIG. 7 is an axonometric view of the lower side of the packaging of FIG. 1.

The container 1 is formed by:

an upper flange 4, on which a sealing film is applied (not shown), e.g. by heat sealing, ultrasonic welding, adhesives, or any other possible sealing method suited to close the open upper part of the container 1;

a side wall 5 with facets (or faces) having a polygonal horizontal section, the side wall terminating at its lower end in an annular projection 6—also visible in FIG. 7—;

an annular lower planar surface 7—formed on said projection 6—, to which a second sealing film is applied (not shown) by any known sealing method;

a base wall 8, extending from the internal upper end of the annular projection 6, to a cylindrical wall 11 (11" in FIG. 4*a*);

a movable base 13 (13' in FIG. 4*a*) used to actuate a plug 14, this movable base being connected by means of a hinge 15 (15' in FIG. 4*a*) (of reduced thickness), to the cylindrical wall 11 (or 11') of the compartment 3, in order to reach a convex form when the plug 14 is made to slide inside the "boring" formed by the cylindrical wall 9 (or 9').

Moreover, some pieces of cutlery (e.g. of plastics) or other fittings (e.g. napkins), or additives of the food product, may be received in the annular recess 10 and are retained from below by said film (not shown) which is applied on the planar annular surface of the annular projection 6 (FIG. 7).

In an embodiment the container 1 is integrally formed (e.g. of moulded plastics). However, the plug 14 forms a separate piece (e.g. of plastics).

Figure 2:
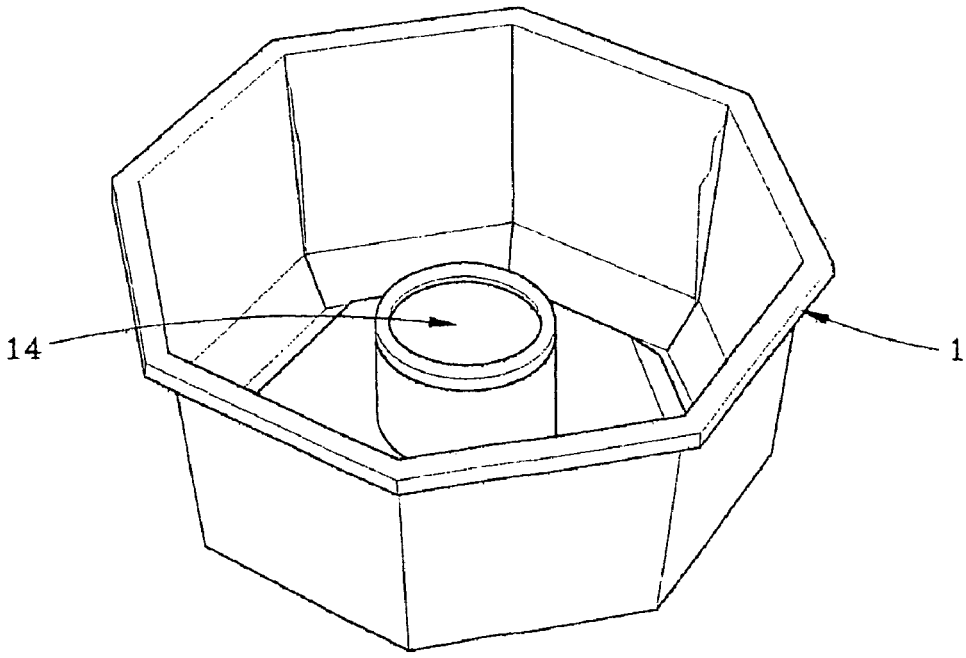
FIG. 2 is a view similar to FIG. 1, the plug being in the closure position.
Figure 3:
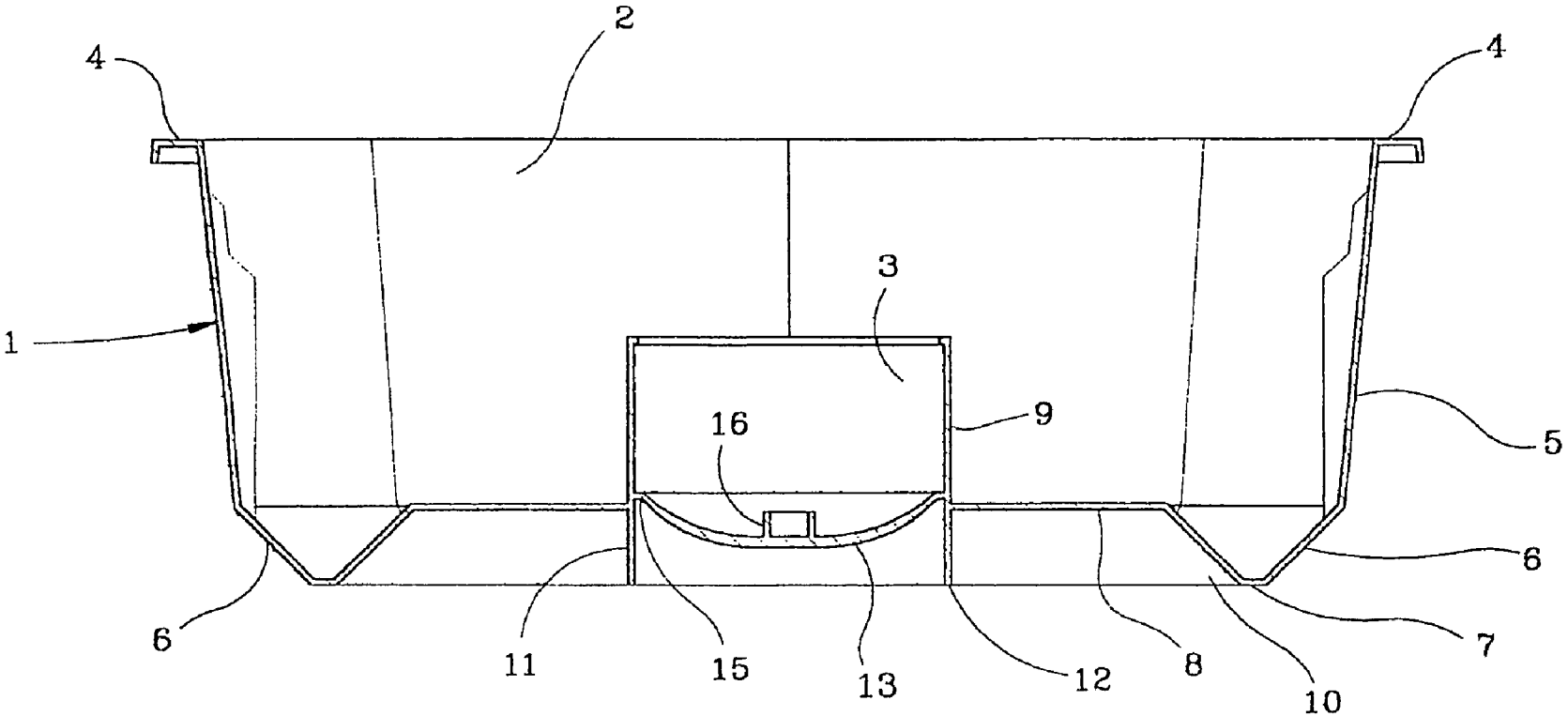
FIG. 3 is a vertical sectional view of the invention shown in FIG. 1 and FIG. 2, without the plug.
Figure 6:
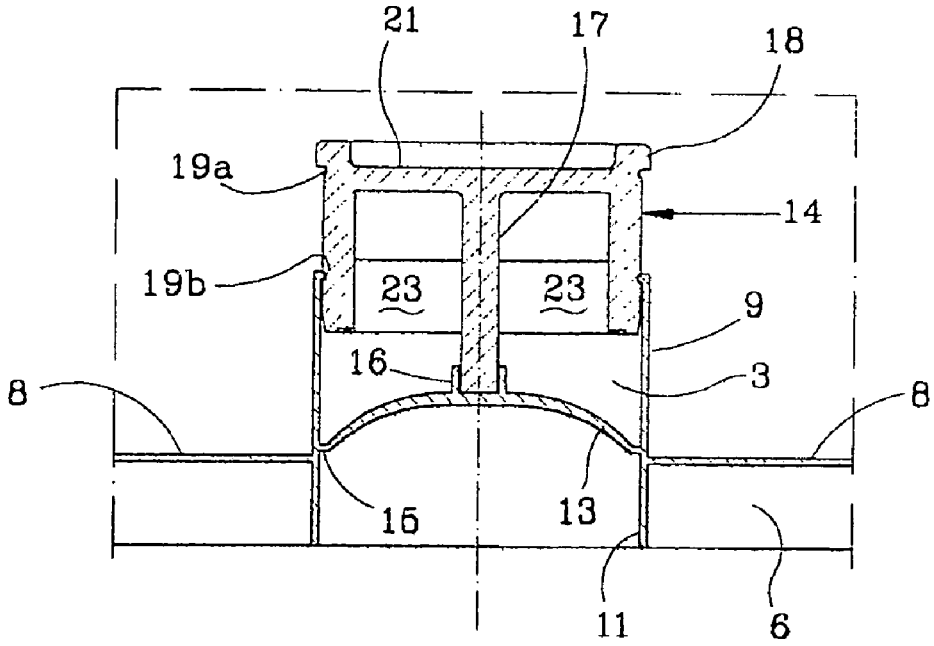
FIG. 6 is a view similar to FIG. 5, the plug being in the opening position.
Figure 5:
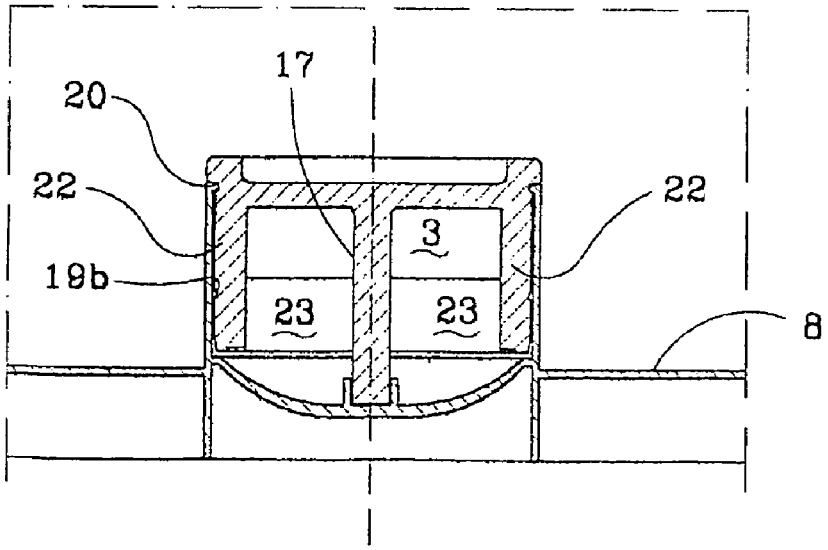
FIG. 5 is a view of a detail of the central portion of the container of FIG. 3, with the plug in the closing position.

It must be stressed that the plug 14 has been omitted for clarity in FIG. 3, to simplify the drawing, since it is shown in any case in the detailed views of FIGS. 5 and 6. Actually, when the packaging is purchased by the user, it includes the plug 14 (in the closure position illustrated in FIGS. 2 and 5), the film applied on the upper side, that is on the upper annular flange 4 (or possibly a removable cover which is also omitted in the drawings), and the film applied on the lower side, that is on the annular planar surface 7 of the projection 6.

To better understand the structure and operation (use modalities) of the packaging according to the present invention, reference will now be made in particular to the FIGS. 5 and 6.

The latter figures are representations in vertical section, limited to the central portion of the container 1, and in particular they show the cylindrical wall 9 of the compartment 3 which contains the sauce or dressing, the lower extension 11 of this cylindrical wall, the circular hinge 15, and part of the base wall 8. Moreover, the plug 14 is inserted (in the initial rest position of FIG. 5), inside the compartment 3, and is in sliding engagement with the inner side of the vertical cylindrical wall 9 of this compartment 3.

The movable base 13 for the actuation of the plug 14 includes centrally a cylindrical rib, or annular cylindrical portion 16, that is integrally formed on the movable base 13.

Said circular rib 16 receives (e.g. by press-fitting) the lower portion of an axial stem 17 of the plug 14. Moreover, the plug 14 has two circular peripheral grooves 19*a* and 19*b*, which are parallel to each other, and the upper end of the cylindrical wall 9 has a (inwardly directed) circular bead or ridge 20 complementary to the shape of the grooves 19*a* and 19*b*, adapted to engage with the upper groove 19*a* in the closing position of the plug 14 (FIG. 5), and with the lower groove 19*b* in the opening position of the plug 14 (FIG. 6).

Figure 1:
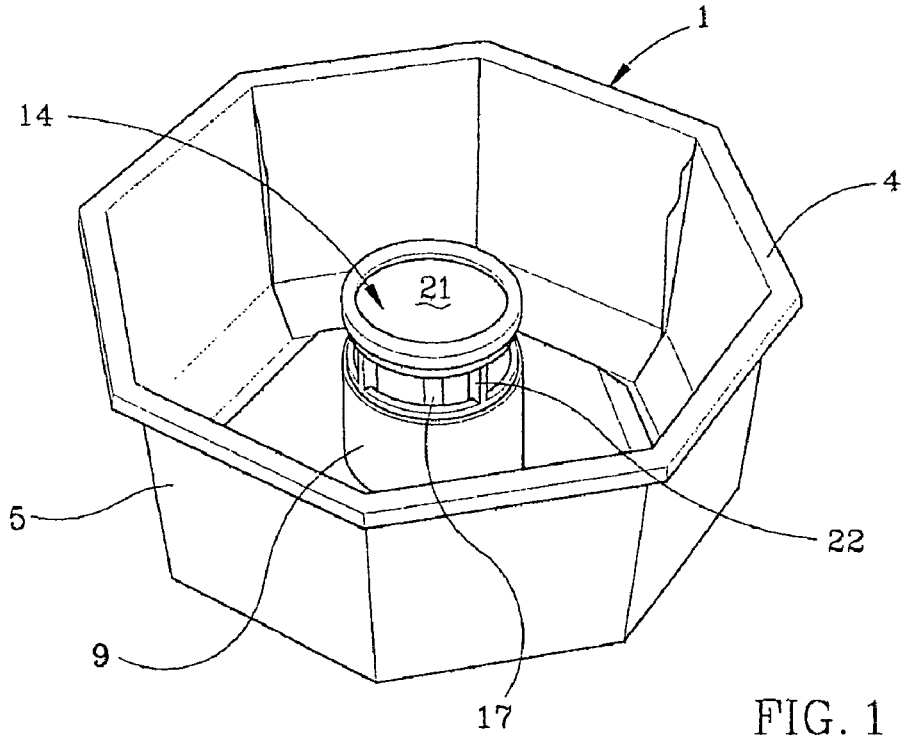
FIG. 1 is an axonometric view of the invention, corresponding to an embodiment of the present invention, without the upper sealing film or cover, and with the plug in the opening position.

The exact configuration of the plug 14 may be inferred—besides from FIGS. 5 and 6—also form FIG. 1. The plug 14 includes a portion shaped like a flanged disc 21, whose circular flange 18 abuts on the upper end of the cylindrical vertical wall 9, in the closure position of the plug 14 (FIG. 5); the plug 14 also includes vertical elements 22, shaped as small rods and extending downwards in a direction perpendicular to the plane of the flanged disc 21, said vertical elements being integral with the latter. The vertical small rods 22 terminate at their lower end in a cylindrical ring 23. The plug 14 is able to slide, by means of the external surfaces of its portions 22 and 23, along the inner side of the cylindrical vertical wall 9. Moreover, it may be noted that the various vertical small rods 22 of the plug 14, are arranged at equal angles along the periphery of the flanged disc 21 that forms the upper part of the plug 14. Thus, the small rods 22 delimit "windows" of equal dimensions, that are dearly visible in FIG. 1, and which allow the leaking of the sauce or dressing from the compartment 3, when the plug 14 is in the opening position (FIGS. 1 and 6). In FIG. 1 the small rods 22 are at 90° with respect to each other.

First of all, the user of the packaging shown in FIGS. 1 to 3, and 5 to 7, removes the lower film, and then, he/she pushes inwardly the movable base 13 towards the inside of the packaging. The movable base lifts the plug 14 by means of the axial stem 17, and at the same time it lifts the sauce or dressing contained in the compartment 3 immediately above the movable base 13. During this operation, the circular ridge 20—that realised a seal in the rest position of the plug 14 (see FIG. 5) thereby preventing the leaking of the sauce or dressing to the compartment 2—disengages from the upper circular groove 19*a*. In the upper position, or end-of-stroke position, of the plug 14, the circular ridge 20 engages the second (lower) circular groove 19*b* of the plug 14, thereby realising again a sealing, so that the sauce etc. can flow only through the windows defined between the vertical small rods 22. In the position shown in FIG. 6, of the plug 14, the movable base 13 will have an upwardly convex configuration.

In the preceding description it is assumed that the words "upper" and "lower", and "upwards" or "downwards", refer to the orientation of the packaging (and therefore of the container 1), that is shown for example in FIGS. 1 and 2.

Without removing the cover (or the upper film), the user turns over the packaging in order to allow the complete downflow of the sauce, or dressing, or bread-crumbs, etc. through the "windows" or apertures formed between the small rods 22. Then, the user shakes the packaging in order to perfectly and uniformly dress a salad, for instance.

At that time, if the food product (e.g. a salad) can be immediately eaten, the user simply removes the upper sealing film or an upper cover, and can directly use the compartment 2 as a bowl.

On the other hand, in case of a food product that must be fried, the user (in this case a cook) must tear the upper film and pour the content in a frying-pan or the like. However, in case of a microwave oven, it will be possible to directly employ the container 1 as a cooking container.

Therefore, it can be seen that the objects of the invention are fully attained. Particularly, it will be impossible to pour the seasoning out of the container 1, since the upper film will not be removed, except when the seasoning operation is completed. Moreover, the sachets (small bags) of the prior art are totally superfluous, and the space inside the compartment 2 may be better used.

Now, we will describe an alternate embodiment of the packaging present invention, referring to FIGS. 1, 2, 4*a*, 4*b* and 7.

Figure 4B:
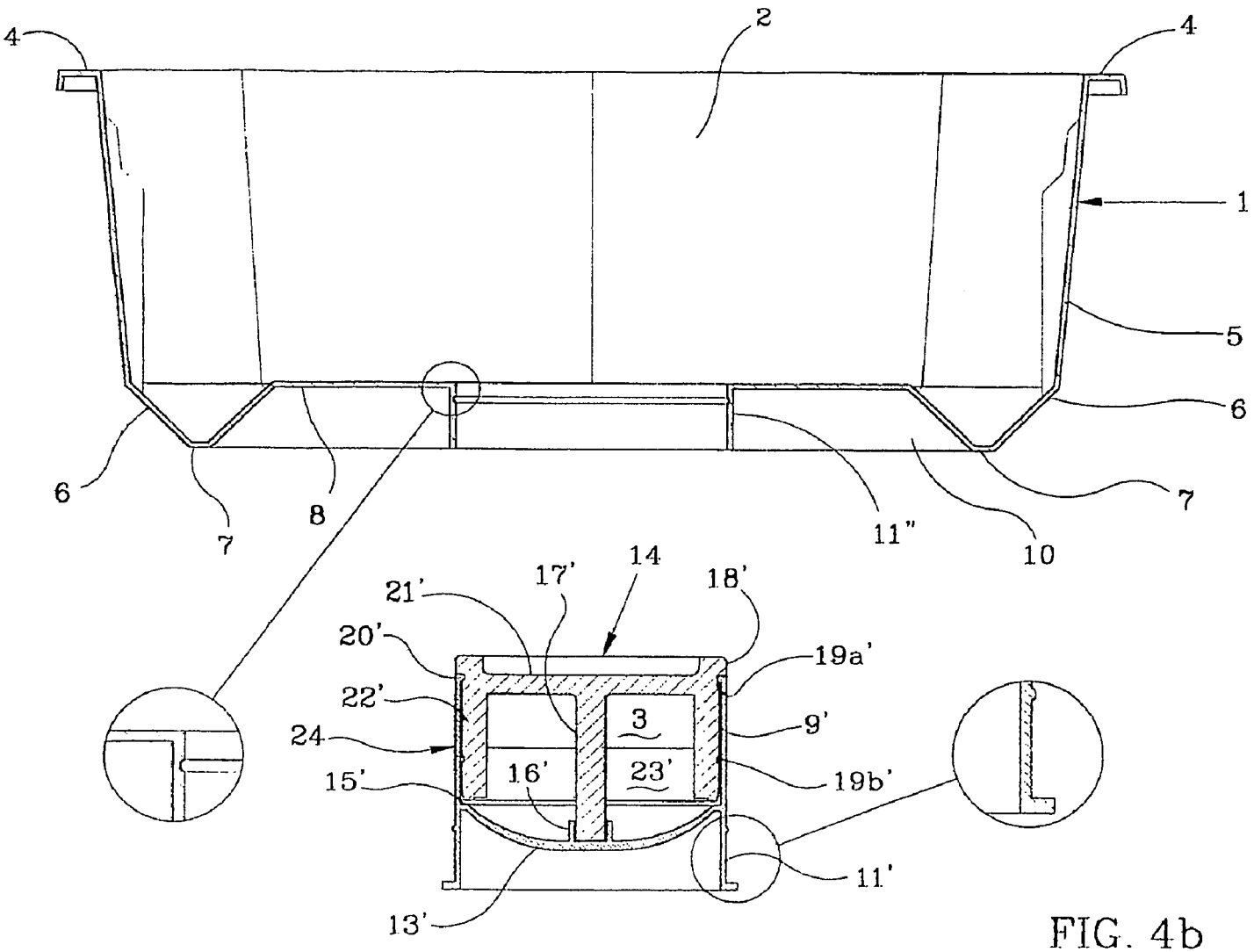

In the embodiment, shown in FIGS. 4*a* and 4*b*, the compartment 3 is formed by a separate container 24 (or "cartridge"), that can be inserted, that is, press-fitted, in a central hole of the container 1, having an inner diameter substantially equal to the external diameter of the separate container 24. The separate container, indicated by a denser hatching, has a cylindrical wall 9' with a downward extension 11', and may be inserted inside a sleeve 11" of the container 1. From the details of FIGS. 4*a* and 4*b*, it can be seen that the downward projection 11' is flanged at its lower end, and moreover it has an annular projection (ridge) acting as a retainer, in order to mutually lock the respective parts. Obviously, the flange acts as a stop, in order to stop the stroke of the separate container 24 towards the inside of the container 1. The plug 14 is located (in the initial rest position shown in FIGS. 4*a* and 4*b*) inside the cartridge 24, and is in sliding contact with the cylindrical vertical wall 9' of the compartment 3.

The movable base 13' for the actuation of the plug 14 has centrally a cylindrical rib, or cylindrical annular portion 16', which is integrally formed on the movable base 13' of the cartridge. Said circular rib 16' receives (e.g. by press-fitting) the lower portion of an axial stem 17' of the plug 14. Moreover, the plug has two peripheral circular grooves 19*a*' and 19*b*', that are parallel to each other, while the upper end of the cylindrical wall 9' has a (inwardly directed) ridge 20', having a complementary shape with respect to the shape of the grooves 19*a*' and 19*b*', and adapted to fit inside the upper groove 19*a*', in the closing position of the plug 14 (FIGS. 4*a* and 4*b*), and with the lower groove 19*b*' in the opening position of the plug 14 (shown in FIG. 2).

The exact configuration of the plug 14 may be inferred, besides from FIGS. 4*a* and 4*b*, also from FIG. 1. The plug 14 comprises a portion having the shape of a flanged disc 21', whose circular flange 18' abuts on the upper end of the vertical cylindrical wall 9' of the cartridge or separate container 24, in the closure position of the plug 14 (see FIGS. 4*a* and 4*b*); the plug 14 also has vertical elements 22', in the form of small rods, extending downwards in orthogonal direction to the plane of the flanged disc 21', and being integral to the latter. The small vertical rods 22' terminate at their lower ends in a cylindrical ring 23'. The plug 14 can slide, by means of the external surfaces of its portions 22' and 23', along the inner side of the vertical cylindrical wall 9' of the separate container 24.

Moreover, it can be noted that the various vertical rods 22' of the plug 14 are arranged at equal angles along the periphery of the flanged disc 21' that forms the upper part of the plug 14. Thus, the small rods 22 form "windows" of equal dimensions, which are clearly visible in FIG. 1, and which allow the leaking of the seasoning/dressing, etc., from the compartment 3, when the plug 14 is in the opening position (FIG. 1).

According to this solution, the final user can freely choose the seasoning/dressing he/she prefers, by independently purchasing a separate container 24 sealed by the respective plug 14, and containing the desired type of seasoning, dressing or the like. Then, after having turned over the packaging, he/she removes the lower sealing film and inserts the separate container 24 (sealed by the respective plug 14) inside the hole of the container 1, defined by the cylindrical sleeve 11". Then, the user simply has to push the movable base 13' inwardly, to the inside of the container 1, and shake the packaging.

Also in this latter solution, the seasoning or the like cannot leak out of the packaging, since the upper sealing film (or the cover) is removed in the last step, that is at the end of the operation.

The invention has been described only for illustrative purposes with reference to its preferred embodiments. It goes without saying that various modifications may be conceived by a skilled person, within the same scope of protection.

For example, the number of compartments 3 is not limited to a single compartment, and if desired, more compartments could be provided if for the preparation of the food product it is necessary to mix together more than two components that must maintained in a separate state up to the preparation time.

Now, an alternate embodiment of the present invention will be described.

The embodiments are similar in that the compartment 3 does not form a separate element (in contrast with the cartridge 24 that can be inserted in the container 1), but is connected to the container in a non-removable manner.

Figure 8:
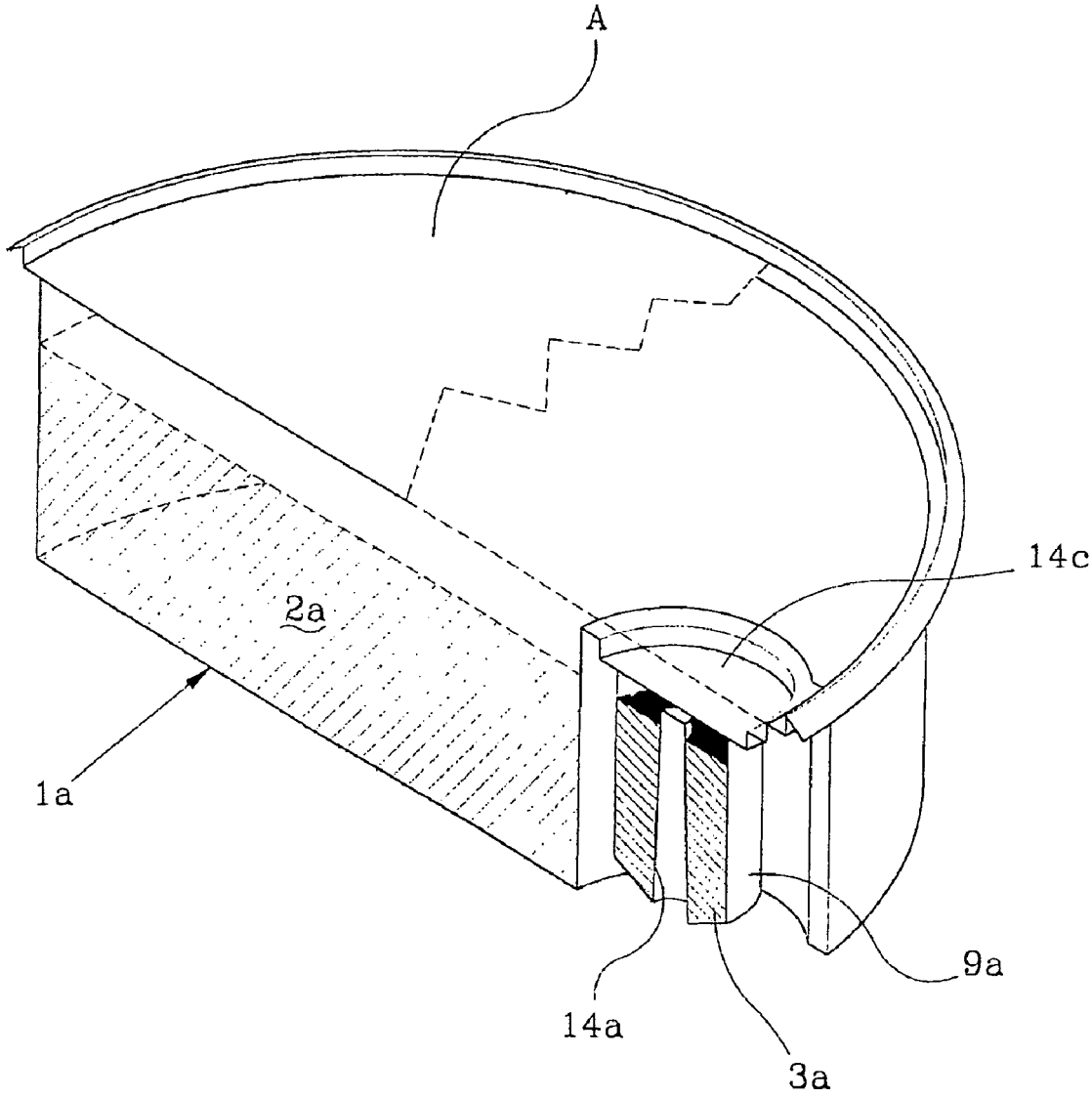
FIG. 8 is a sectional axonometric view of the packaging, corresponding to an embodiment of the present invention.
Figure 10:
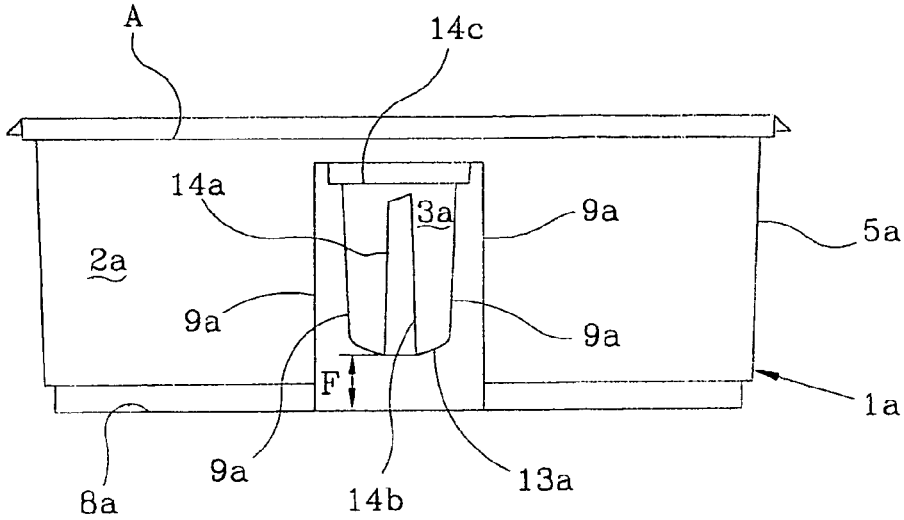
FIG. 10 is a schematic view in vertical section, analogous to FIG. 9, in which, however, the additional compartment is located centrally in the packaging instead of laterally.
Figure 9:
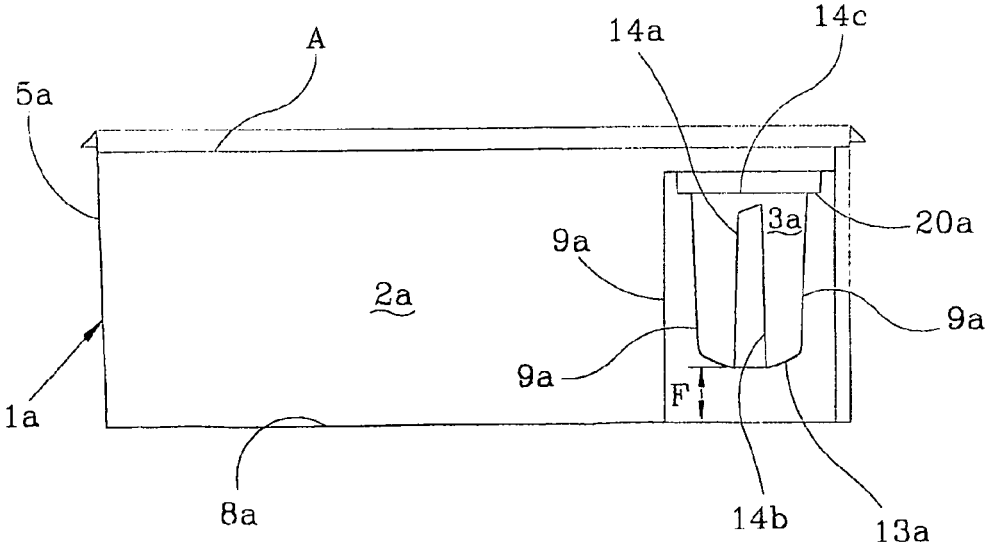
FIG. 9 is a schematic view of a vertical section of the packaging shown in FIG. 8.

With reference to FIGS. 8 to 10, the packaging of the present invention essentially comprises a single container 1*a*, which for instance is manufactured using a plastics moulding process. The configuration of the container 1*a* is such as to give rise to two different compartments, indicated by the numerals 2*a* and 3*a* respectively. The first compartment 2*a*, which has a greater size than the second compartment 3*a*, contains the ready-made food product (schematically indicated by a hatching in FIG. 8), while the second compartment 3*a* is used to introduce therein the seasoning, dressing, or the like (which is also schematically shown by a hatching in FIG. 8). Thus, the container 1*a* forms a small bowl or small basin, of cylindrical external shape, and having inside it a second cylindrical body, which gives rise to the compartment 3*a* for the dressing, seasoning, or the like.

It should be noted that the container 1*a* is formed by a thin wall of plastics, that has been adequately shaped in the moulding process, said thin wall being horizontal at the base 8*a* of the container 1*a*, and vertical at the cylindrical external wall 5*a* and at the cylindrical wall 9*a* of the inner dressing's compartment 3*a*.

The thin cylindrical wall 9*a* extends upwards only for a reduced height as compared with the external cylindrical wall 5*a*, and then it extends downwards so as to form a kind of "well"; the latter gives rise to the compartment 3*a* that contains the dressing, or seasoning, or bread-crumbs, etc. Centrally, the compartment 3*a* has a push rod or pointed rod 14*a*, which internally is hollow, and is formed again by said thin wall of plastic moulding material. Thus, the container 1*a* is really formed of a single moulded piece of plastics, consisting of a thin wall having the described configuration.

The push rod 14*a* therefore forms an element having a shape like a frustum of a cone, which is internally hollow (see blind hole 14*b*), and which is itself formed by said continuous thin wall. Due to the presence of the push rod 14*a*, the seasoning will occupy—inside the compartment 3*a*—, an annular substantially cylindrical region, as may be clearly seen in FIG. 8. The base 13*a* of the seasoning compartment 3*a*, having a bulged shape, is located at a level higher than the base 8*a* of the compartment 2*a* of the ready-made food product, as indicated by the double arrow F. The reason for this will be explained further below.

Even in this embodiment the seasoning or the like is stored separately from the ready-made food product, since a sealing film 14*c* is provided at the upper side of the compartment 3*a* and is applied laterally—on the circular step 20*a*—. Moreover, the container 1*a* is sealed at its upper end by a film A, or by a removable cover made of plastics or the like, that temporarily hermetically doses the container 1*a*.

The only difference between FIGS. 8 and 9, on the one hand, and FIG. 10 on the other hand, concerns the position of the compartment 3*a* for the seasoning; in FIGS. 8 and 9 this compartment 3*a* is located laterally, while in the version shown in FIG. 10 it is located centrally with respect to the base 8*a* of the container.

Also in this case the object of the invention can be immediately recognised by the following description of its use.

Figure 12:
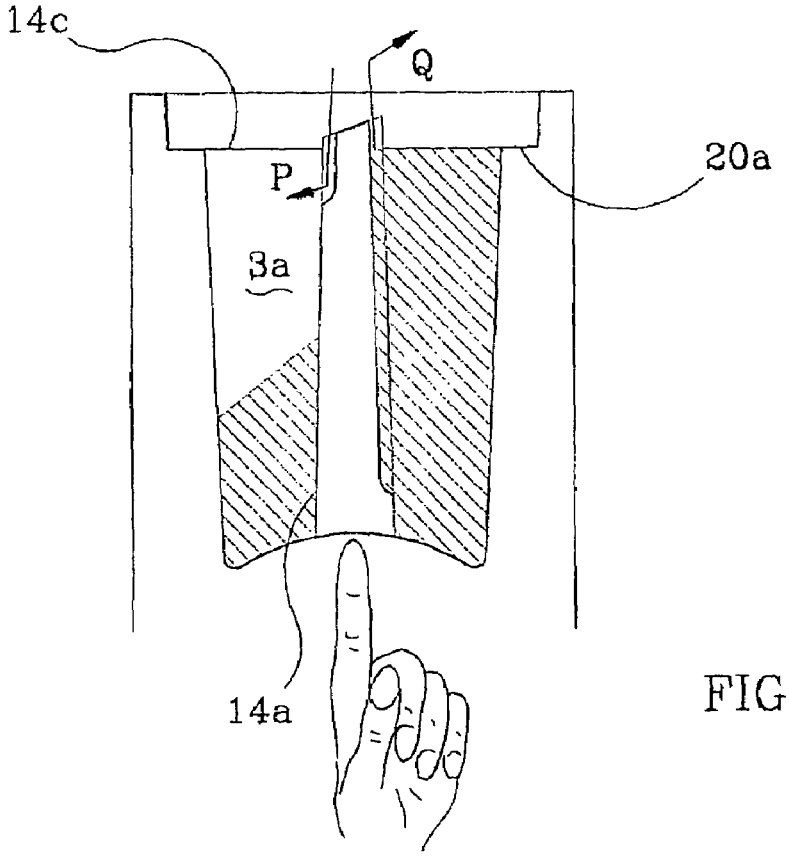
FIG. 12 is a view analogous to FIG. 11, showing the use of the push rod for breaking and tearing the sealing film, corresponding to an embodiment of the present invention.

When the packaging is still sealed, that is before removing the sealing film A from the upper part of the container 1*a*, the user presses with his/her hand on the bottom 13*a* of the seasoning's compartment 3*a*, so as to deform the thin wall of the container at the location of this inner compartment 3*a*, as shown in FIG. 12. Consequently, the push rod 14*a* will be lifted and will eventually pierce the closing film 14*c* of the inner compartment 3*a*. Without relieving this pressure, the user slowly turns over the packaging, in order to allow the complete downflow of the seasoning or dressing towards the inside of the compartment 2*a* that contains the food products to be dressed (salad, other vegetables, etc.). Then, the user will simply have to shake the packaging to obtain a perfectly and uniformly dressed salad. At the end of this operation, the external film A (shown clearly in FIG. 8) will be detached. From the above description, it follows that in order to prevent an accidental piercing of the film 14*c* that seals the compartment 3*a* for the seasoning/dressing, during packing, transport and selling operations, it is necessary to provide a safety space (denoted by the double arrow F), that has already been mentioned without however clarifying its function.

For completeness, and referring again to FIGS. 11 and 12, it should be noted that according to practical tests it results that the downflow of the seasoning/dressing from the compartment 3*a* is facilitated by the presence of small channels on the lateral surface of the push rod 14*a* used for piercing the closure film 14*c*. Thus, the lateral wall of the push rod 14*a* is recessed ("milled") on diametrically opposite sides of the push rod, in such a way as to give rise to respective longitudinal channels, of half-cylindrical shape, which extend each as far as the upper end of the push rod 14*a*; this end is slanted in order to facilitate piercing of the film 14*c*.

Figure 11:
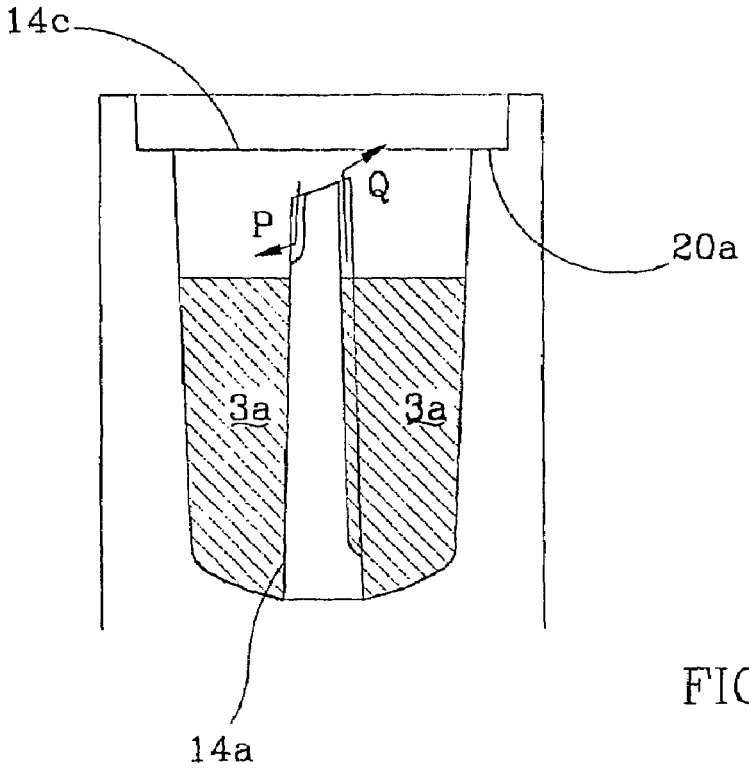

In FIG. 11, the arrow P denotes the path of the air (directed towards the inside of the compartment 3*a*) after piercing of the film 14*c* (see FIG. 12), whereas the arrow Q denotes the path of the seasoning/dressing or the like, that flows out of the compartment 3*a* and reaches the adjacent compartment 2*a*.

The advantages of the present invention are obvious to the skilled person. In fact, the packaging must be opened only shortly before the food product is eaten, and the system guarantees a perfect dressing.

Although the invention has been extensively described with regard to only some distinct—but specific—embodiments thereof, a skilled person may easily imagine several constructive modifications without thereby arriving at results out of the scope of protection conferred by this document.

The structure of the packaging may also be more complex. The container could—for instance—comprise a sealing and removable cover in lieu of the film A, and/or a sliding push rod 14*a* which slides with respect to the base 13 of the compartment 3*a*. All these modifications are obviously within the reach of the ordinary skilled person that has taken cognisance of the solutions proposed herein, and for this reason they are to be considered included in the present invention.

The invention claimed is:

1. A disposable packaging for food products, comprising an upwardly open container (1), an upper closure element (A) of the container (1), a compartment (2) of the container (1) for a first component of the food product, and at least an additional compartment (3) that is integral with the container (1) or is rigidly fixed thereto in a non-removable manner, and which is used for an additional component of the food product to be mixed to said first component, said additional compartment (3), which is initially sealed, having movable members (13, 14) that may be actuated by the user from outside the container (1) and which has a communication path between the compartment (2) and said additional compartment (3), thereby allowing to mix the first component of food product, located inside the compartment (2), to the additional component of food product coming from the additional compartment (3), said movable members being formed by a base (13) of said additional compartment (3), that is connected by means of a hinge (15) to the walls (9) of the compartment (3), and said base (13) being movable between a first- or rest-position, and a second position, whereby during the displacement to the second position the base acts on a movable plug (14) which slides along the walls of said additional compartment (3); characterized in that said plug (14) has lateral apertures which give rise to said communication between the compartment (2) and the additional compartment (3), in said second position of the movable base (13), when said plug (14) has reached a second, final position, without releasing itself from said walls (9) of the compartment (3).

2. The disposable packaging according to claim 1, wherein said upper closure member (A) is a film.

3. The disposable packaging according to claim 1, wherein said movable plug (14) is connected to said movable base (13) through an axial stem (17).

4. The disposable packaging according to claim 3, wherein, in said two positions of the movable base (13) and plug (14), a coupling of the kind "circular groove/circular ridge" (19*a*, 19*b*; 20) results in a sealing between the plug (14) and the wall (9) of the additional compartment (3).

5. The disposable packaging according to claim 1, wherein the lower part of said container defines a recess adapted to receive pieces of cutlery therein.

6. The disposable packaging according to claim 1, wherein said upper closure element is formed by a film, and wherein said container further comprises a lower closure element formed by a film, wherein said lower film closes a coupling hole defined through a base wall of the container.

7. The disposable packaging according to claim 1, further comprising a separate and sealed container having walls and being attachable to said container, wherein said container further comprises a coupling hole defined by a sleeve integral with said container, said coupling hole being adapted for the attachment of said sealed separate container.

8. The disposable packaging according to claim 7, wherein said sealed separate container is retained in a coaxial position inside the said coupling hole of said container, by the friction force and the radial pressure which is exerted by said walls of said sealed separate container on said sleeve which surrounds said hole of said container.

* * * * *